United States Patent [19]

Caliri

[11] 4,051,783

[45] Oct. 4, 1977

[54] MODEL RAILROAD LAYOUT

[75] Inventor: Frank Caliri, Marlboro, Mass.

[73] Assignee: Peerless Industries Inc., Marlboro, Mass.

[21] Appl. No.: 701,905

[22] Filed: July 1, 1976

[51] Int. Cl.[2] ..... B61B 13/00

[52] U.S. Cl. ..... 104/151; 46/212; 46/216; 104/147 A; 104/DIG. 1

[58] Field of Search ..... 104/151, 147 A, DIG. 1, 104/148 R, 149; 238/10 E, 10 R, 10 A; 246/31, 48, 57, 193; 212/130, 131; 46/212, 216, 257, 262, 263; 318/282, 286, 587

[56] References Cited

U.S. PATENT DOCUMENTS

| | | | |
|---|---|---|---|
| 1,402,757 | 1/1922 | Frohne | 104/DIG. 1 |
| 2,685,844 | 8/1954 | Short et al. | 238/10 E X |
| 2,961,797 | 11/1960 | Bonanno | 104/151 X |
| 3,361,082 | 1/1968 | Leslie | 104/151 |
| 3,675,586 | 7/1972 | Haddad | 104/149 |

*Primary Examiner*—Robert J. Spar
*Assistant Examiner*—Randolph A. Reese
*Attorney, Agent, or Firm*—Norman S. Blodgett; Gerry A. Blodgett

[57] ABSTRACT

Model railroad layout with a length of track formed near the ends of the rails with gaps and connected to an electrical source and a control means to reverse polarity on the rails when the engine wheel bridges a gap.

7 Claims, 3 Drawing Figures

MODEL RAILROAD LAYOUT

BACKGROUND OF THE INVENTION

In the display of model railroad trains, it has been common practice to use an endless pattern of track. This is true not only in the case of the model railroad hobbyist, but also the retail sales outlet. The display and sale of such equipment usually takes place in a "hobby shop" and is sold along with many other items; therefore, space is at a premium and it is difficult to justify one large area of the store for the installation of a conventional endless track layout for demonstrating the operation of the model railroad equipment. In some cases, the hobbyist himself moves to an apartment and has no room to install a large conventional layout. Furthermore, even if he has a large layout in his cellar, he may wish to display certain important, unusual or expensive portions of his equipment in his den or even in his office. When used in this way, as a "conversation piece ", it would be desirable to show the equipment in operation, but the usual endless track layout is too large for such purposes. These and other difficulties experienced with the prior art devices have been obviated in a novel manner by the present invention.

It is, therefore, an outstanding object of the invention to provide model railroad layout which occupies very little space.

Another object of this invention is the provision of model railroad layout for displaying equipment in a retail sales store.

A further object of the present invention is the provision of model railroad layout for operating equipment as a display unit in a home or office.

It is another object of the instant invention to provide model railroad layout for continuous back-and-forth operation of equipment in an automatic manner.

A still further object of the invention is the provision of model railroad layout that is simple in nature, that is inexpensive to manufacture, and that is capable of a long life of useful service with a minimum of maintenance.

It is a further object of the invention to provide model railroad layout including a simple and rugged control means for reversing electrical polarity on the track to cause to-and-fro movement of an engine.

With these and other objects in view, as will be apparent to those skilled in the art, the invention resides in the combination of parts set forth in the specification and covered by the claims appended hereto.

SUMMARY OF THE INVENTION

In general, the present invention relates to a model railroad layout with a track of limited length having two parallel rails. One rail has an electrical gap adjacent one end of the track and the other rail has a gap adjacent the other end of the track. A source of direct current electricity is connected to the track, one rail being connected to ground and the other rail being connected to the positive voltage side, so that operating current passes from one rail to the other via the wheels and motor of the engine. Control means is provided to switch the polarity of the electricity applied to the rails to reverse the direction of operation of the engine when a wheel passes over a gap and electrically connects the rail on both sides of the gap.

More specifically, resilient bumpers are provided at the ends of the track and the control means is located in a miniature building at one end of the track. The control means includes a silicon control rectifier and a switching relay.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
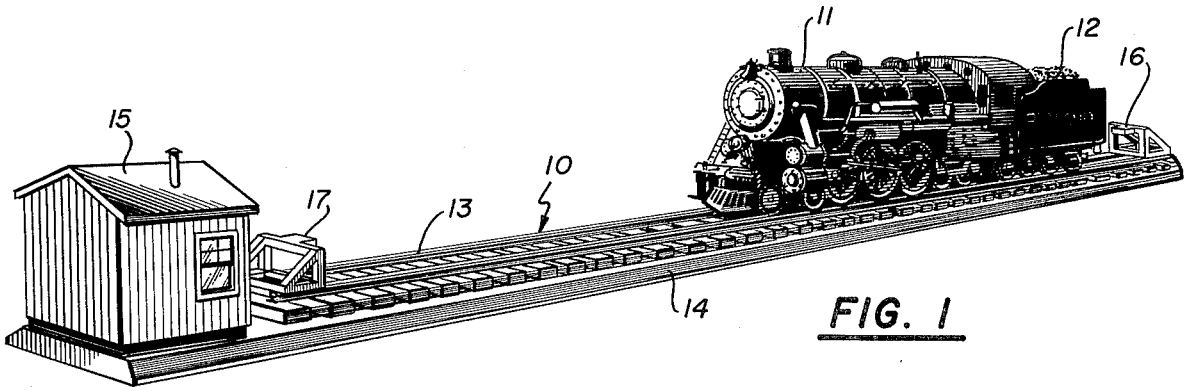
FIG. 1 is a perspective view of a model railroad layout embodying the principles of the present invention.

Referring first to FIG. 1, wherein are best shown the general features of the invention, the model railroad layout, indicated by the reference numeral 10, is shown in use with a direct-current driven engine 11 having a coal tender 12. The engine and tender have metal wheels that rest on a track 13 of a convenient length mounted on a base 14. Also mounted on the base adjacent one end of the track is a building 15 and at the ends of the track are located bumpers 16 and 17.

Figure 2:
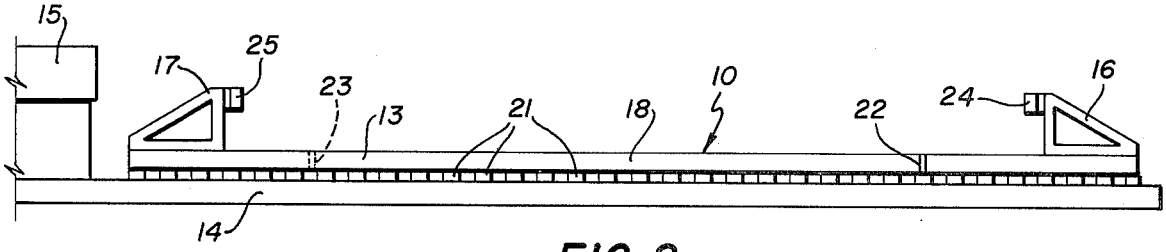
FIG. 2 is a side elevational view of the layout.

Referring to FIG. 2, it can be seen that the track 13 consists of two parallel rails 18 and 19 (see FIG. 3) carried on ties 21. Located adjacent the end of the rail 18 at one end of the track is a switching means in the form of a gap 22. Close to the other end of the track, the rail 19 is provided with a switching means in the form of a gap 23. The bumper 16 is shown as having a rigid structure attached to the rails and having a resilient means such as a rubber block 24 facing toward the other end of the track; the bumper 17 is similarly provided with a rubber block 25.

Figure 3:
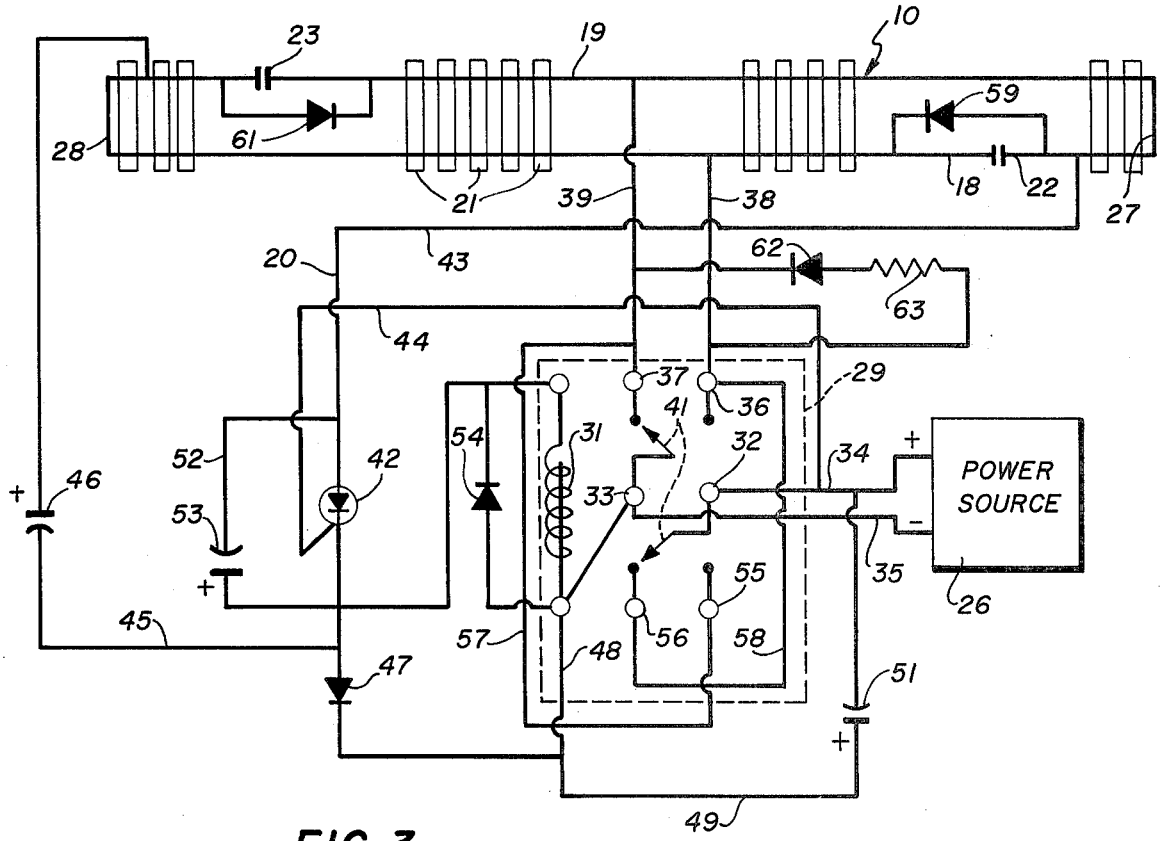
FIG. 3 is an electrical schematic diagram of the layout.

In FIG. 3, it can be seen that the layout 10 is provided with a source 26 of direct-current electricity connected to the track. The positive side of the source is connected (indirectly) to the rail 18, while the negative side (ground) is connected to the rail 19. In this way, the electric motor in the engine 11 is operated by current passing from one rail to the other. A control means 20 (located in the building 15) is provided to switch the polarity of the electricity applied to the rails to reverse the direction of movement of the engine when it approaches one of the switch means (gaps 22 or 23). This reversing occurs when a metal wheel passes over a gap and momentarily electrically connects the rails on both sides of the gap. The distance between each gap and its adjacent bumper is selected so that the wheel of the engine 11 (or an attached car, such as the coal tender 12) electrically bridges the gap before the remainder of the engine or car strikes the bumper. The bumpers, therefore, are only present for emergencies.

The ends of the rails 18 and 19 are electrically connected by wires 27 and 28, so that the short section of each rail beyond its gap is of the opposite polarity to the remainder of the rail. A relay 29, forming part of the control means 20, is connected between the electrical source 26 and the track 13, the relay being of the two-pole, double-throw type having an energizing coil 31. Two input contacts 32 and 33 of the relay are connected by lines 34 and 35 to the positive and negative terminals, respectively, of the electrical source 26. Two output contacts 36 and 37 of the relay are connected by lines 38 and 39 to the rails 18 and 19, respectively. The relay also includes a contact element 41 for reversing the electrical connections between the input contacts 32 and 33 (on the one hand) and the output contacts 36 and 37 (on the other hand).

The control means 20 includes a silicon control rectifier (SCR) 42 having a first line 43 leading to the short section of rail beyond the gap 22 and electrically connected to the major portion of the rail 19. A second line 44 is connected from the rectifier 42 to the line 34 at the positive voltage side of the source 26. A third line 45 leads from the rectifier 42 to one side of a variable capacitor 46 the other side of which is connected to the short portion of the rail 19 which lies beyond the gap 23 and which is electrically connected to the major portion of the rail 18. The third line 45 is connected through a diode 47 to a line 48 to one end of the energizing coil 31. The line 48 is also connected to a line 49 leading through a variable capacitor 51 to the line 34 at the positive terminal of the electrical source 26. The first line 43 is connected by a line 52 through a variable capacitor 53 to the other side of the relay coil 31. A diode 54 is connected between the two ends of the coil 31. A line connects one end of the coil 31 to the input contact 33 which, it will be recalled, is connected through the line 35 to the ground or negative side of the electrical source 26. The relay 29 includes two other output contacts 55 and 56. The contact 55 is connected by a line 57 to the output contact 37, while the contact 56 is connected by a line 58 to the output contact 36. A diode 59 bridges the gap 22, while a diode 61 is connected across the gap 23. A diode 62 and a resistance 63 are connected between the output contacts 36 and 37.

The operation of the layout will now be readily understood in view of the above description. With the relay 29 in the condition shown in FIG. 3, the coil 31 is unenergized and the contact element joins the output contact 37 to the input contact 33 and joins the output contact 36 to the input contact 32 (by means of the output contact 56). The rail 18 is, therefore, at positive voltage, while the rail 19 is at negative voltage (ground). The extreme right end of the rail 18 beyond the gap 22 is always negative and positive voltage is blocked by the diode 59.

The engine 11 and the coal tender 12 are placed on the the track in the manner shown in FIG. 1 and immediately begins to move, say, to the right away from the building 15 and toward the bumper 16. Eventually, the metal wheel of the coal tender 12 bridges the gap 22 and this triggers the SCR rectifier 42. This, in turn, permits current to pass through the relay coil 31 and causes the contact element 41 to move to its second position in which the contact element connects the input contact 33 to the output contact 56 and the input contact 32 to the output contact 55. The rail 18 then becomes negative and the rail 19 becomes positive. The engine and its equipment then moves to the left toward the building 15. When the front wheel of the engine bridges the gap 23, the polarity of the track is reversed again to its original condition. The engine begins to move again to the right. The electrical bridging of the gap 23 causes positive electricity from the main part of the rail 19 to flow to the short portion on the other side of the gap. This positive pulse acts through the line 45 to shut off the SCR rectifier 42, so that current no longer flows through the coil 31 and the relay returns to its "normal" condition. The diode 62 and the resistor 63 are used to offset the resistance in the relay coil 31 and to maintain equal speed of the engine when moving in either direction.

In a commercial version of the invention, the thyristor SCR rectifier 42 has a capacity of 4 amps., while the diodes 59, 61, 62, 47 and 54 have a similar capacity. The source 26 is a 12-volt D.C. power supply. The resistor 63 is 47 ohms with a capacity of 2 watts. The relay 29 is a DPDT of 2 amps. The capacitor 51 has 10 microfared, 25 volt rating. The capacitor 46 is 5 microfared, 25 volt, and the capacitor 51 is 200 microfared, 25 volt.

The advantages of the invention will be readily understood in the light of the above description. For the retail merchant the use of one (or several) of the layouts in the window or store display serves to attract customers' attention to promote sales, particularly of locomotives, train accessories, and the like. In the preferred embodiment, the layout is only 1¾ inches wide and 6 feet long. The model railroad enthusiast can use the layout for point-to-point operational display of his favorite locomotives. It can also be used in the expansion of conventional layouts as spur and express tracks, as automatic freight yards and passage terminals, traction systems, and many others that may be limited only by the imagination and ingenuity of the user. The layout is particularly useful in filling the needs of the apartment dweller or the owner of a small home who, because of limited space, has been unable to fulfill a desire for an operational model railroad. Because of the particular nature of the polarity reversing equipment, the track can be extended to any desired length. Its rugged and simple construction gives a long life of reversing directional movement without attention from the operator. Even if the model railroad enthusiast has a full conventional layout in his basement, with the present invention he is able to have a supplemental operative display of his favorite locomotive either in his living room (in a bookcase) or in his business office.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Model railroad layout for use with a direct current motor-driven engine, comprising a. a track having a finite length and consisting of two parallel rails, one rail having a switching means consisting of a gap in the rail adjacent one end of the track and the other having a switching means adjacent the other end of the track, b. a source of direct current electrically connected to the track, one rail being connected to ground and the other rail to the positive voltage side, so that current passes from one rail, through a wheel of the engine, through its motor, and through another wheel to the other rail, and c. control means to switch the polarity of the electricity applied to the rails to reverse the direction of the motion of the engine when it approaches a switching means, the control means reversing the engine when a wheel passes over a gap and electrically connects the rail on both sides of the gap.

2. Model railroad layout as recited in claim 1, wherein a resilient bumper is located each end of the track with its contact element directed toward the other end, the distance between the contact element and the gap in the rail at that end being sufficiently long that the engine will normally be reversed in direction by contact of its wheel with the gap before contact of the engine is made with the bumper.

3. Model railroad layout as recited in claim 1, wherein the track is mounted in a rigid elongated base, wherein a miniature railroad building is mounted on the base adjacent one end of the track, and wherein the central means is contained in the building.

4. Model railroads layout as recited in claim 1, wherein the ends of the rails are electrically connected, so that the short section or rail beyond the gap is of the opposite electrical polarity to the remainder of the rail.

5. Model railroad layout as recited in claim 4, wherein a relay is connected between the said source and the track, the relay being of the two-pole, double-throw type having an energizing coil, two input contacts connected to the two sides of the surface, and two output contacts connected to the two rails, the relay also including a contact element for reversing the electrical connections between the input contacts and the output contacts.

6. Model railroad layout as recited in claim 5, wherein the control means includes a silicon control rectifier having a first lead connected to one rail, a second lead connected to the positive side of the electrical source, and a third lead connected to one side of the energizing coil of the relay.

7. Model railroad layout as recited in claim 6, wherein the said first lead is connected through a capacitor to the other side of the energizing coil.

* * * * *